US010383490B2

(12) United States Patent
Nishiyama

(10) Patent No.: US 10,383,490 B2
(45) Date of Patent: Aug. 20, 2019

(54) TOILET SEAT DEVICE

(71) Applicant: AISIN SEIKI KABUSHIKI KAISHA, Kariya-shi (JP)

(72) Inventor: Shinji Nishiyama, Ichinomiya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 1 day.

(21) Appl. No.: 15/892,928

(22) Filed: Feb. 9, 2018

(65) Prior Publication Data

US 2018/0228323 A1 Aug. 16, 2018

(30) Foreign Application Priority Data

Feb. 13, 2017 (JP) ..... 2017-023893

(51) Int. Cl.
*E03D 9/08* (2006.01)
*A47K 13/10* (2006.01)

(52) U.S. Cl.
CPC ..... *A47K 13/10* (2013.01); *E03D 9/08* (2013.01)

(58) Field of Classification Search
CPC ..... A47K 13/10; E03D 9/08
USPC ..... 4/246.1
See application file for complete search history.

(56) References Cited

U.S. PATENT DOCUMENTS 8,555,427 B2 * 10/2013 Stauber ..... A47K 13/10 4/246.1
2010/0306910 A1 * 12/2010 Chen ..... A47K 13/10 4/246.1

FOREIGN PATENT DOCUMENTS

| | | |
|---|---|---|
| JP | 2000-300468 | 10/2000 |
| JP | 2004-154418 | 6/2004 |
| JP | 2006-115985 | 5/2006 |
| JP | 2007-50068 | 3/2007 |

* cited by examiner

*Primary Examiner* — Tuan N Nguyen
(74) *Attorney, Agent, or Firm* — Oblon, McClelland, Maier & Neustadt, L.L.P.

(57) ABSTRACT

A toilet seat device includes: a toilet seat; an opening/closing device configured to open and close the toilet seat; a detection sensor configured to detect seating of a user on the toilet seat; and a controller configured to control the opening/closing device such that, when the toilet seat is in a closed state, the opening/closing device opens the toilet seat based on determination that the detection sensor is brought into a non-detection state before a predetermined seating determination time for determining the seating of the user on the toilet seat elapses after the detection sensor is brought into a detection state.

10 Claims, 4 Drawing Sheets

TOILET SEAT DEVICE

CROSS REFERENCE TO RELATED APPLICATIONS

This application is based on and claims priority under 35 U.S.C. § 119 to Japanese Patent Application 2017-023893, filed on Feb. 13, 2017, the entire contents of which are incorporated herein by reference.

TECHNICAL FIELD

This disclosure relates to a toilet seat device.

BACKGROUND DISCUSSION

In the related art, there has been proposed a type of toilet seat device in which a toilet seat attached to a toilet bowl is automatically opened (see, e.g., JP 2006-115985 A (Reference 1)). The toilet seat device of Reference 1 includes a footwear detection sensor, which is capable of detecting footwear by detecting a detection target element provided on a toe portion of the footwear when the footwear of a user is on the floor surface in front of the toilet bowl, and automatically opens the toilet seat when the footwear detection sensor detects the footwear in the state where a toilet lid is opened. Thus, when a man, wearing footwear, stands in front of the toilet bowl while urinating, the toilet seat is automatically opened, and thus the man does not need to open the toilet seat with a hand.

Incidentally, in recent years, toilet seat devices have been increasingly configured as washing toilet seat devices that inject wash water to a local region of the user. Such toilet seat devices may include a detection sensor that detects whether a user is sitting on a toilet seat in order to prevent erroneous injection of wash water. In that case, as in the above-described toilet seat device, when the toilet seat device includes a dedicated detection sensor that detects whether a man is standing in front of the toilet bowl in order to automatically open the toilet seat, the number of detection sensors may be increased, which results in a complicated configuration and is disadvantageous in terms of costs.

Thus, a need exists for a toilet seat device which is not susceptible to the drawback mentioned above.

SUMMARY

A gist of a toilet seat device according to an aspect of this disclosure resides in that the toilet seat device includes: a toilet seat; an opening/closing device configured to open and close the toilet seat; a detection sensor configured to detect seating of a user on the toilet seat; and a controller configured to control the opening/closing device such that, when the toilet seat is in a closed state, the opening/closing device opens the toilet seat based on determination that the seating detection sensor is brought into a non-detection state before a predetermined seating determination time for determining the seating of the user on the toilet seat elapses after the detection sensor is brought into a detection state.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

A mode for carrying out this disclosure will be described using an embodiment.

Embodiment

Figure 1:
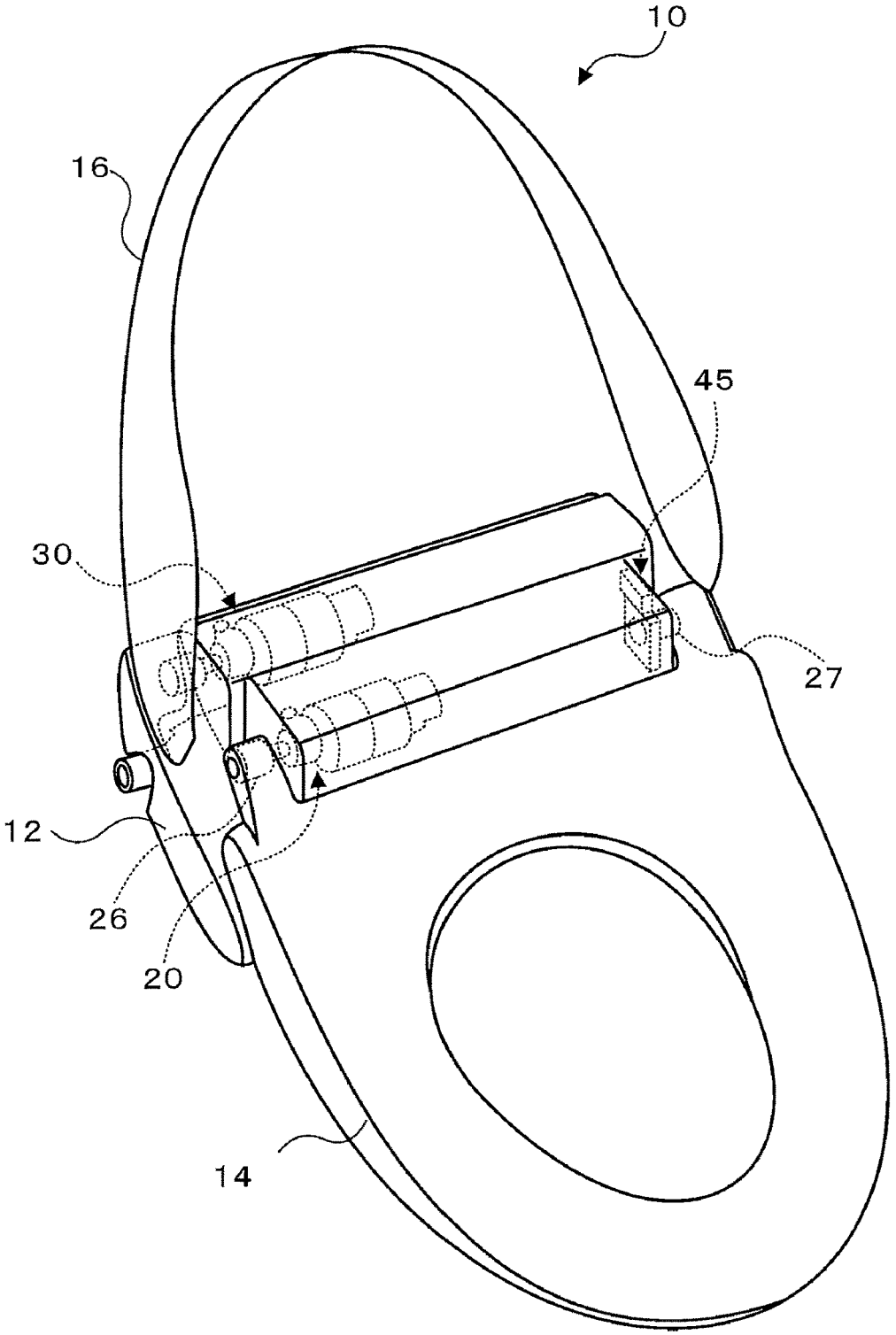
FIG. 1 is a view illustrating a configuration of a toilet seat device.
Figure 2:
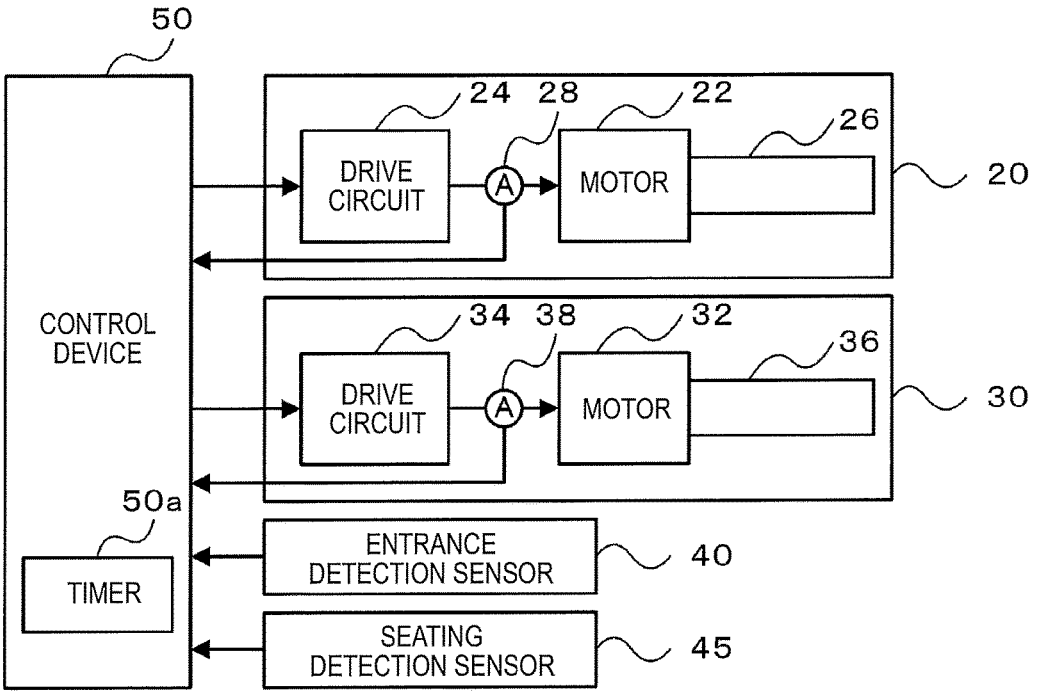
FIG. 2 is a block diagram with regard to the control of the toilet seat device.
Figure 3A:
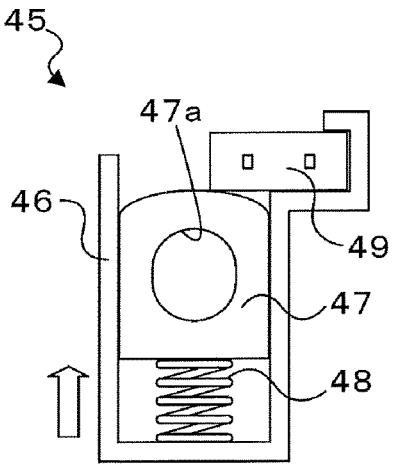
FIGS. 3A and 3B are views illustrating a configuration of a seating detection sensor.
Figure 3B:
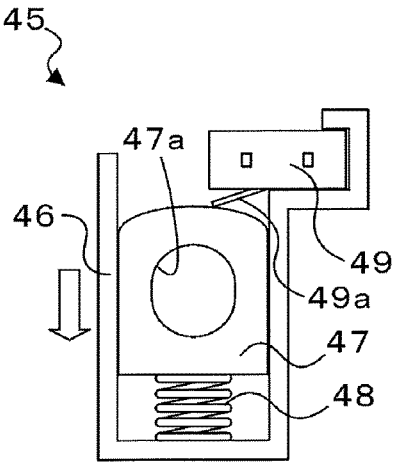

FIG. 1 is a view illustrating a configuration of a toilet seat device 10, FIG. 2 is a block diagram related to the control of the toilet seat device 10, and FIGS. 3A and 3B are views illustrating a configuration of a seating detection sensor 45. The toilet seat device 10 is provided on the upper surface of a toilet bowl (not illustrated), and is configured as a washing toilet seat device capable of washing a local region of a user by injecting wash water from a nozzle (not illustrated) to the local region of the user sitting on a toilet seat 14. As illustrated in FIG. 1, the toilet seat device 10 includes a body 12 which is provided behind the upper surface of the toilet bowl, the toilet seat 14 and a toilet lid 16 which are supported to be opened or closed with respect to the body 12, a toilet seat opening/closing device 20 which is mounted in the body 12 and opens and closes the toilet seat 14, a toilet lid opening/closing device 30 which is mounted in the body 12 and opens and closes the toilet lid 16, and a control device 50 (see FIG. 2), which controls the entire device.

As illustrated in FIG. 2, the toilet seat opening/closing device 20 includes a motor 22, a drive circuit 24 which drives the motor, a drive shaft 26 which serves as an output shaft to rotate (open or close) the toilet seat 14 by the drive force of the motor 22 which is transmitted via, for example, a transmission gear (not illustrated), a rotating shaft 27 (see FIG. 1) opposite to the drive shaft 26, and a current sensor 28 which detects the current of the motor 22. The drive circuit 24 is connected to the control device 50, and drives the motor 22 based on a control signal from the control device 50. In addition, in the same manner as the toilet seat opening/closing device 20, the toilet lid opening/closing device 30 includes a motor 32, a drive circuit 34, a drive shaft 36, a rotation shaft (not illustrated), and a current sensor 38, and a detailed description thereof will be omitted.

The control device 50 includes a timer 50*a* which measures time, in addition to, for example, a CPU, a ROM, or a RAM (not illustrated). The control device 50 may output a control signal to the toilet seat opening/closing device 20 (the drive circuit 24) or the toilet lid opening/closing device 30 (the drive circuit 34) so as to automatically open and close the toilet seat 14 or the toilet lid 16, or may output a control signal to a nozzle unit (not illustrated) so as to perform wash water injection control. In addition, as illustrated in FIG. 2, for example, a detection signal (current value) from the current sensors 28 and 38, a detection signal from an entrance detection sensor 40 capable of detecting the entrance of a user into a toilet room in which the toilet seat device 10 is disposed, and a detection signal from the seating detection sensor 45 capable of detecting the seating of the user on the toilet seat 14 are input to the control device 50. The control device 50 outputs a control signal for automatically opening or closing the toilet lid 16 to the toilet lid opening/closing device 30 based on the detection signal input from the entrance detection sensor 40.

The seating detection sensor 45 of the embodiment disclosed here is configured as a limit-switch-type sensor. As illustrated in FIG. 1 and FIGS. 3A and 3B, the seating detection sensor 45 includes a slider 47 which is movable in a vertical direction (gravity direction) inside a case 46 disposed in the body 12, a spring 48 which is disposed on the bottom portion of the case 46 so as to bias the slider 47 upward, and a limit switch 49 which is disposed on the upper portion of the case 46 and has a lever member 49*a* protruding into the movement range of the slider 47 located therebelow. The slider 47 is formed with an opening 47*a* into which the rotating shaft 27 of the toilet seat 14 is fitted, and moves in the vertical direction together with the rotating shaft 27 of the toilet seat 14. Since a pressing force in the gravity direction (the weight of the user) is not applied to the toilet seat 14 when the user is not sitting on the toilet seat 14, no force is applied to move the slider 47 downward. Therefore, the slider 47 is located at the upper side of the movement range by the biasing force of the spring 48 (see FIG. 3A), and presses the lever member 49*a*, causing the limit switch 49 to be in an ON state (energized state). Thus, when the limit switch 49 is in the ON state since no pressing force is applied to the toilet seat 14, a seating absence signal, which indicates the absence of seating, is input to the control device 50, as the detection signal from the seating detection sensor 45. In addition, since the slider 47 is located at the upper side by the biasing force of the spring 48, the rear side of the toilet seat 14 is slightly raised with respect to the upper surface of the toilet bowl. On the other hand, when the user is sitting on the toilet seat 14, the pressing force in the gravity direction (the weight of the user) is applied to the toilet seat 14, causing the toilet seat 14 to be lowered to the position at which the toilet seat 14 is in contact with the upper surface of the toilet bowl. As a result, a force is applied to move the slider 47 downward. For this reason, the slider 47 is located at the lower side of the movement range against the biasing force of the spring 48 (see FIG. 3B), and releases the pressing force applied to the lever member 49*a*, thereby putting the limit switch 49 in an OFF state (non-energized state). Thus, when the limit switch 49 is in the OFF state because the pressing force is applied to the toilet seat 14, a seating presence signal, which indicates the presence of seating, is input to the control device 50, as the detection signal from the seating detection sensor 45.

Figure 4:
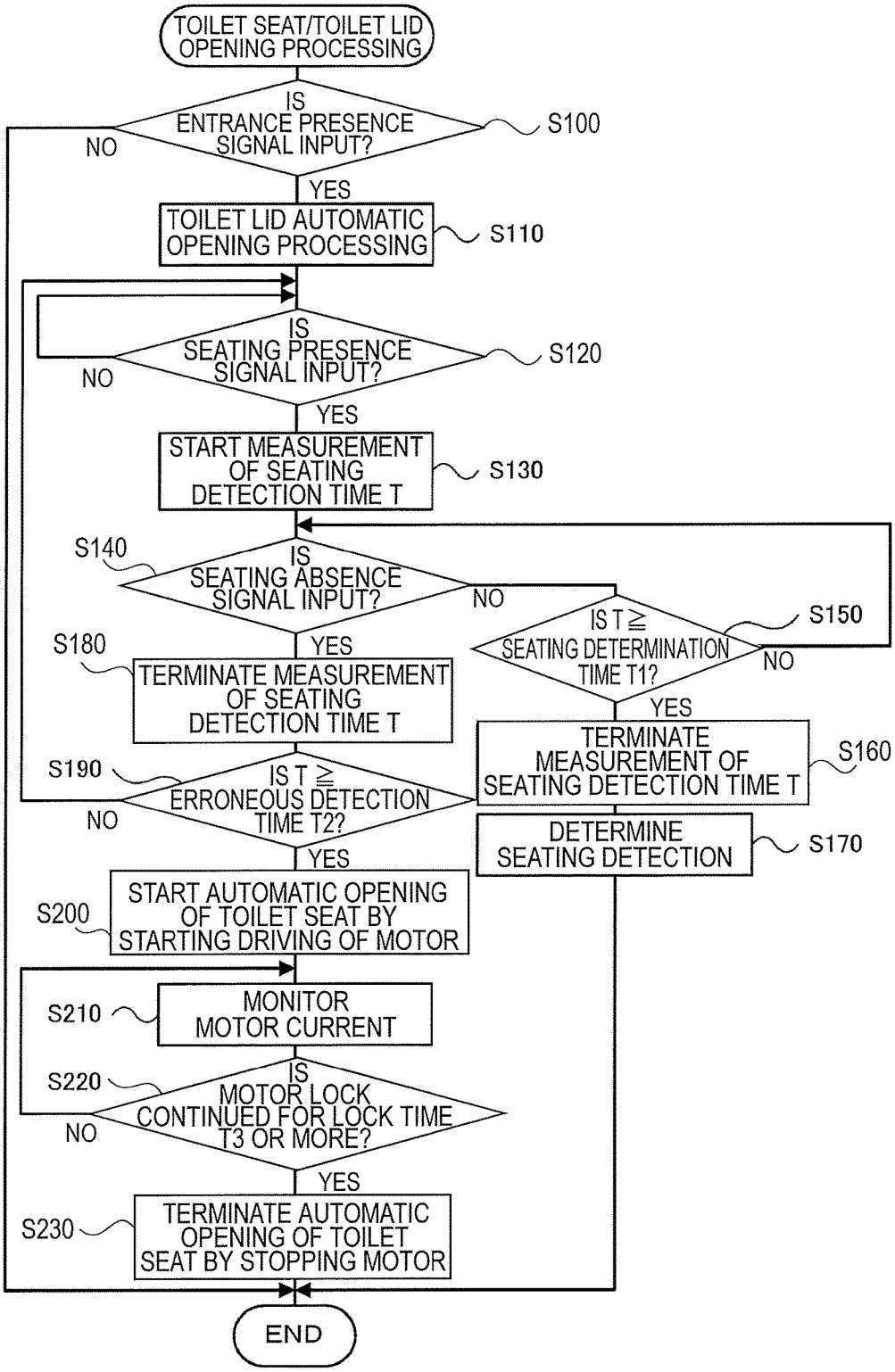
FIG. 4 is a flowchart illustrating an example of a toilet seat/toilet lid opening processing.

Next, the operation of the toilet seat device 10 configured as described above, more particularly, a processing when opening the toilet seat 14 and the toilet lid 16, will be described. FIG. 4 is a flowchart illustrating an example of the toilet seat/toilet lid opening processing. This processing is executed, for example, at predetermined time interval when the toilet seat 14 and the toilet lid 16 are in the closed state.

When the toilet seat/toilet lid opening processing is executed, first, the control device 50 determines whether or not an entrance presence signal, which indicates the presence of entrance of the user, is input as the detection signal from the entrance detection sensor 40 (S100). When it is determined that no entrance presence signal is input, the control device 50 immediately terminates this processing. On the other hand, when it is determined that the entrance presence signal is input in S100, the control device 50 outputs a control signal to the toilet lid opening/closing device 30 and performs an automatic opening processing of the toilet lid 16 (S110). Then, when the toilet lid 16 is opened to a predetermined upper limit opening degree and the motor 32 is locked, a current value detected by the current sensor 38 increases (lock current). Therefore, when the opening processing of the toilet lid 16 is performed, the control device 50 monitors the current value detected by the current sensor 38, thereby determining the completion of the opening processing of the toilet lid 16 based on variation in the current of the motor 32, and stopping the driving of the motor 32.

Following the automatic opening processing of the toilet lid 16 in S110, the control device 50 waits the input of the seating presence signal, which indicates the presence of seating of the user, as the detection signal from the seating detection sensor 45 (S120). As described above, since the seating presence signal is input when a pressing force in the gravity direction is applied to the toilet seat 14, the seating presence signal is also input when the user pushes the upper surface of the toilet seat 14 with a hand or the like without sitting on the toilet seat 14, in addition to a case where the user is sitting on the toilet seat 14. In addition, when a predetermined time elapses after no seating presence signal is input from the seating detection sensor 45 and the detection signal from the entrance detection sensor 40 is changed from the entrance presence signal to an entrance absence signal, the control device 50 may, for example, automatically close the toilet lid 16 and terminate this processing.

When it is determined that the seating presence signal is input in S120, the control device 50 starts the measurement of a seating detection time T by the timer 50*a* (S130). The seating detection time T is the time during which the seating detection sensor 45 is brought into the detection state as the seating presence signal is input from the seating detection sensor 45. Then, the control device 50 waits determination of any one of whether or not the seating absence signal, which indicates the absence of seating of the user, is input as the detection signal from the seating detection sensor 45 (S140) and whether or not the seating detection time T is equal to or longer than a seating determination time T1 during the measurement (S150). Here, the seating determination time T1 is a time in the range of about several hundred milliseconds to several seconds, and in the embodiment disclosed here, for example, is 1 second. When it is determined that the seating detection time T is equal to or longer than the seating determination time T1 in S150 before it is determined that the seating absence signal is input in S140, the control device 50 terminates the measurement of the seating detection time T by the timer 50*a* (S160), determines seating detection as in that the user is surely sitting on the toilet seat 14 (S170), and terminates this processing. In addition, when the seating detection is determined, the control device 50 may execute, for example, the above-described wash water injection control.

On the other hand, when it is determined that the seating detection sensor 45 is brought into a non-detection state as the seating absence signal is input in S140 before it is determined that the seating detection time T is equal to or longer than the seating determination time T1 in S150, the control device 50 terminates the measurement of the seating detection time T (S180), and determines whether or not the seating detection time T, the measurement of which is terminated, is equal to or longer than an erroneous detection time T2 (S190). Here, the erroneous detection time T2 is a time within which there is a possibility of erroneously detecting the user due to chattering of the limit switch 48 of the seating detection sensor 45, and is set to, for example, about several hundred milliseconds, that is shorter than the seating determination time T1. That is, a case where the seating detection sensor 45 is brought into the non-detection state as the seating absence signal is input before the seating detection time T is equal to or longer than the seating determination time T1 corresponds to, for example, a case where the user does not sit on the toilet seat 14, but temporarily pushes the upper surface of the toilet seat 14, for example, by hand, and then separates the hand from the toilet seat 14. When it is determined that the seating detection time T is shorter than the erroneous detection time T2 in S190, the control device 50 determines that erroneous detection occurs due to the chattering of the limit switch 48 of the seating detection sensor 45, and returns to S120 so as to repeat the processing. In addition, when it is determined that the seating detection time T is equal to or longer than the erroneous detection time T2 in S190, the control device 50 outputs a control signal to the toilet seat opening/closing device 20 to start the driving of the motor 22, thereby starting the automatic opening of the toilet seat 14 (S200). Thus, after excluding the possibility of erroneous detection due to the chattering of the seating detection sensor 45, when it is detected that the user pushes the upper surface of the toilet seat 14 in the gravity direction, with a hand or the like only for a short time such as less than 1 second, the control device 50 automatically opens the toilet seat 14 on the assumption that the automatic opening of the toilet seat 14 is instructed. Therefore, in the embodiment, the user is able to open the toilet seat 14 without touching the lower surface (back surface) of the toilet seat 14.

When the automatic opening of the toilet seat 14 is started, the control device 50 monitors the current value of the motor 22 detected by the current sensor 28 (S210), and based on the current value, waits until the lock of the motor 22 is continued for a predetermined lock time T3 or more (S220). When it is determined that the lock of the motor 22 has continued for the lock time T3 or more, the control device 50 outputs a control signal to the toilet seat opening/closing device 20 to stop the driving of the motor 22, thereby terminating the automatic opening of the toilet seat 14 (S230), and then terminates this processing. In addition, the lock time T3 is a time of about several hundred milliseconds, and in the embodiment, is set to 500 msec, for example. Here, the lock (lock current) of the motor 22 occurs not only when the toilet seat 14 is opened to a predetermined upper limit opening degree, but also when an attempt to automatically open the toilet seat 14 is made even though the user is sitting on the toilet seat 14 and thus the toilet seat 14 is not operated. Therefore, even if an attempt to automatically open the toilet seat 14 is erroneously made because it is determined that the user pushes the toilet seat 14 only for a short time due to erroneous detection by the seating detection sensor 45, the automatic opening of the toilet seat 14 is terminated when the lock current is detected for the lock time T3. Therefore, it is possible to appropriately protect the motor 22 by preventing the overload of the motor 22 from continuing for a long time.

When the toilet seat 14 is in the closed state, the toilet seat device 10 of the embodiment described above automatically opens the toilet seat 14 based on determination that the seating detection sensor 45 is brought into the non-detection state before the predetermined seating determination time T1 for determining the seating of the user on the toilet seat 14 elapses after the seating detection sensor 45 is brought into the detection state. Thus, since the seating detection sensor 45, which is used to determine the seating of the user, may also be used to instruct the opening of the toilet seat 14, it is possible to automatically open the toilet seat 14 with a simple configuration without providing a dedicated sensor for instructing the opening of the toilet seat 14. In addition, an opening operation button for instructing the opening of the toilet seat 14 may not be provided on a remote controller for operating the toilet seat device 10. In addition, by posting an explanation that the toilet seat 14 can be automatically opened by pushing the upper surface of the toilet seat 14 on the rear surface of the toilet lid 16, the wall surface in the toilet room, or the remote controller for operating the toilet seat device 10, etc., it is possible to urge the user to automatically open the toilet seat 14.

In addition, since the toilet seat device 10 stops the driving of the motor 22 when the lock of the motor 22 of the toilet seat opening/closing device 20 is detected for the predetermined lock time T3 after the toilet seat 14 is automatically opened, it is possible to protect the motor 22 when an instruction to open the toilet seat 14 is erroneously detected even though the user is sitting on the toilet seat 14 in which state the toilet seat 14 cannot be opened.

In addition, the toilet seat device 10 automatically opens the toilet seat 14 based on determination that the seating detection sensor 45 is brought into the non-detection state after the erroneous detection time T2, which is shorter than the seating determination time T1 and within which there is a possibility of erroneous detection due to the chattering of the limit switch 48 of the seating detection sensor 45, elapses after the seating detection sensor 45 is brought into the detection state, it is possible to suppress erroneous detection of the instruction to open the toilet seat 14.

In the embodiment, the toilet seat 14 is automatically opened based on determination that the user is temporarily detected for a time, which is equal to or longer than the erroneous detection time T2 due to chattering, which is shorter than the seating determination time T1. However, the embodiment is not limited thereto, and the determination using the erroneous detection time T2 may not be performed. That is, the processing in S190 of the toilet seat/toilet lid opening processing of FIG. 4 may be omitted, and regardless of whether or not the seating detection time T is equal to or longer than the erroneous detection time T2, the toilet seat 14 may be automatically opened when the user is temporarily detected for a time shorter than the seating determination time T1.

In the embodiment, the termination of the automatic opening of the toilet seat 14 is determined based on the current value of the motor 22. However, the embodiment is not limited thereto, and the termination of the automatic opening of the toilet seat 14 may be determined based on the rotation angle of the drive shaft 26 (the opening degree of the toilet seat 14) detected by, for example, a rotation angle sensor, instead of or in addition to the current value of the motor 22. In addition, for example, the motor 22 may be protected by terminating the automatic opening of the toilet seat 14 when the amount of variation per unit time (rotation speed) of the rotation angle of the drive shaft 26 (the opening degree of the toilet seat 14) is equal to or less than a predetermined variation amount.

Figure 5:
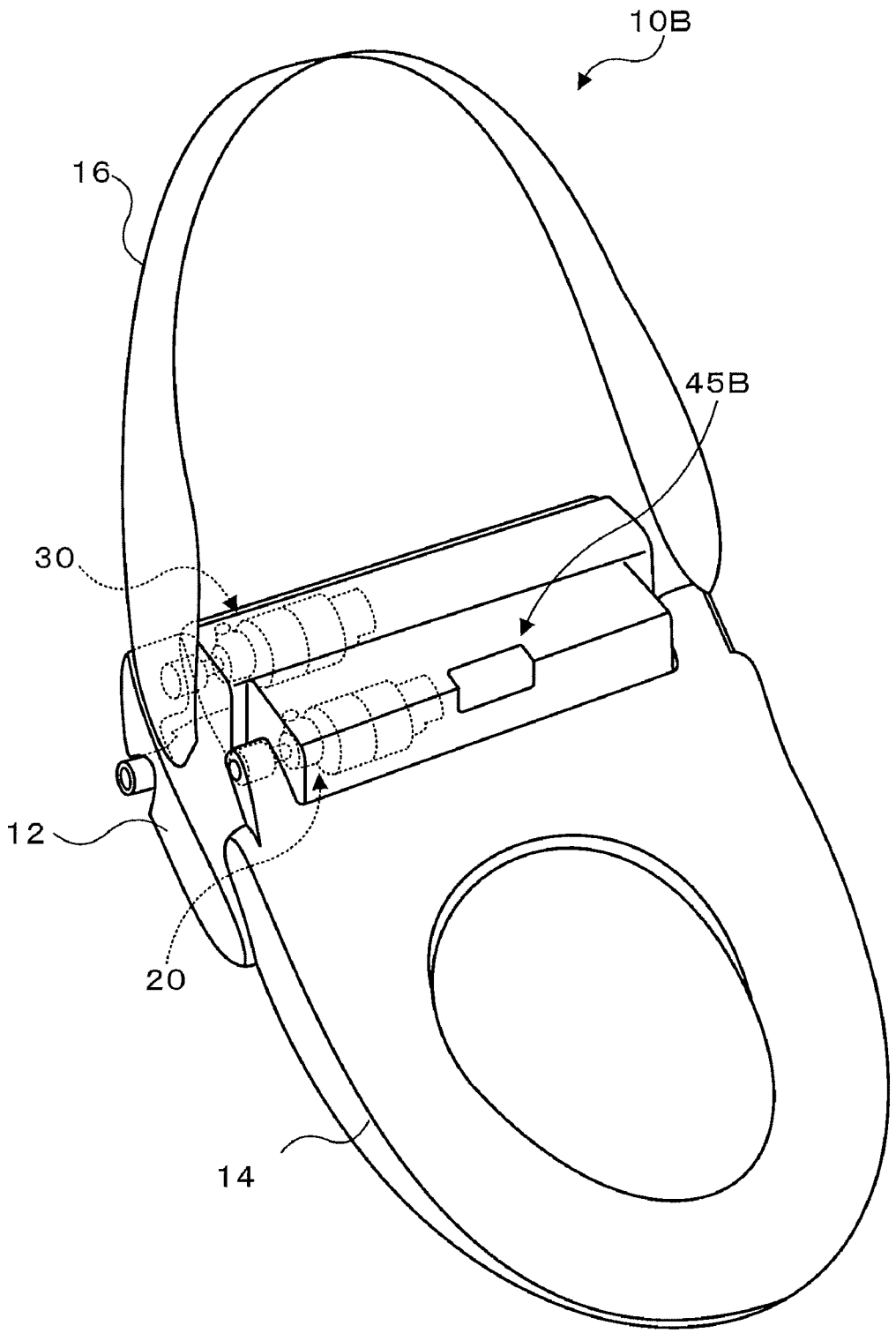
FIG. 5 is a view illustrating a configuration of a toilet seat device according to a modification.

In the embodiment, although the seating detection sensor 45 configured as a limit-switch-type sensor is used, the embodiment is not limited thereto, and any other type of sensor, for example, a seating detection sensor 45B configured as an infrared-reflection-type sensor, may be used, as illustrated in a toilet seat device 10B according to a modification of FIG. 5. In this case, the user may instruct the opening of the toilet seat 14, for example, by temporarily putting the hand within the detection range of the seating detection sensor 45B. In this case, in order to suppress the seating detection sensor 45B from detecting an unintended operation, the erroneous detection time T2 may be set to be shorter than the seating determination time T1.

In the embodiment, the opening operation button for instructing the opening of the toilet seat 14 may not be provided on the remote controller for operating the toilet seat device 10, but the opening operation button of the toilet seat 14 may be provided on the remote controller. In this way, since the user is able to automatically open the toilet seat 14 by either operating the opening operation button of the remote controller or performing a predetermined operation (in the embodiment, a pressing operation) on the toilet seat 14, it is possible to enhance the convenience of the user.

A correspondence relationship between the major elements of the embodiment and the major elements of the disclosure described in the section "SUMMARY" will be described. In the embodiment, the toilet seat 14 corresponds to a "toilet seat", the toilet seat opening/closing device 20 corresponds to an "opening/closing device", the seating detection sensor 45 corresponds to a "detection sensor", and the control device 50 corresponds to a "controller". In addition, the motor 22 corresponds to a "motor".

In addition, the correspondence relationship between the major elements of the embodiment and the major elements of the disclosure described in the section "SUMMARY" do not limit the elements of the disclosure described in the section "SUMMARY" in that the embodiment is an example for concretely describing a mode for carrying out the disclosure described in the section "SUMMARY". That is, the interpretation of the disclosure described in the section "Summary" should be performed based on the description in that section, and the embodiment is merely given as a concrete example of the disclosure described in the section "SUMMARY".

Although the present disclosure has been described above with reference to an embodiment, this disclosure is not limited to the embodiment at all, and may be implemented in various forms without departing from the spirit of this disclosure.

A gist of a toilet seat device according to an aspect of this disclosure resides in that the toilet seat device includes: a toilet seat; an opening/closing device configured to open and close the toilet seat; a detection sensor configured to detect seating of a user on the toilet seat; and a controller configured to control the opening/closing device such that, when the toilet seat is in a closed state, the opening/closing device opens the toilet seat based on determination that the seating detection sensor is brought into a non-detection state before a predetermined seating determination time for determining the seating of the user on the toilet seat elapses after the detection sensor is brought into a detection state.

The toilet seat device of this disclosure controls the opening/closing device such that, when the toilet seat is in a closed state, the opening/closing device opens the toilet seat based on determination that the detection sensor is brought into a non-detection state before a predetermined seating determination time for determining the seating of the user on the toilet seat elapses after the detection sensor is brought into the detection state. Thus, the detection sensor, which is used to determine the seating of the user, may also be used to instruct the opening of the toilet seat. Therefore, it is possible to automatically open the toilet seat with a simple configuration without providing a dedicated sensor for instructing the opening of the toilet seat.

In the toilet seat device of the aspect of this disclosure, the opening/closing device may open and close the toilet seat via driving of a motor, and the controller may control the opening/closing device such that the opening/closing device stops the driving of the motor, based on determination that the motor is locked for a predetermined lock time after the controller controls the opening/closing device so as to open the toilet seat via the driving of the motor. In this way, when the detection sensor, which is used to determine the seating of the user, is also used to instruct the opening of the toilet seat, it is possible to protect the motor even when the instruction to open the toilet seat is erroneously determined and the toilet seat cannot actually be opened.

In the toilet seat device of the aspect of this disclosure, the detection sensor may be configured to switch ON/OFF of a mechanical contact thereof when a pressing force in a gravity direction is applied to the toilet seat, and the controller may control the opening/closing device such that the opening/closing device opens the toilet seat based on determination that the detection sensor is brought into the non-detection state after a predetermined erroneous detection time, which is shorter than the predetermined seating determination time and within which there is a possibility of erroneous detection due to chattering of the mechanical contact of the detection sensor, elapses after the detection sensor is brought into the detection state. In this way, when the detection sensor, which is used to determine the seating of the user, is also used to instruct the opening of the toilet seat, it is possible to suppress the instruction to open the toilet seat from being erroneously determined.

This disclosure can be used, for example, in the manufacturing industry of toilet seat devices.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A toilet seat device comprising:

a toilet seat;

an opening/closing device configured to open and close the toilet seat;

a detection sensor configured to detect seating of a user on the toilet seat; and a controller configured to control the opening/closing device such that, when the toilet seat is in a closed state, the opening/closing device opens the toilet seat based on determination that the detection sensor is brought into a non-detection state before a predetermined seating determination time for determining the seating of the user on the toilet seat elapses after the detection sensor is brought into a detection state.

2. The toilet seat device according to claim 1, wherein the opening/closing device opens and closes the toilet seat via driving of a motor, and the controller controls the opening/closing device such that the opening/closing device stops the driving of the motor, based on determination that the motor is locked for a predetermined lock time after the controller controls the opening/closing device so as to open the toilet seat via the driving of the motor.

3. The toilet seat device according to claim 2,
wherein the detection sensor is configured to switch on/off of a mechanical contact thereof when a pressing force in a gravity direction is applied to the toilet seat.

4. The toilet seat device according to claim 3,
wherein the controller controls the opening/closing device such that the opening/closing device opens the toilet seat based on determination that the detection sensor is brought into the non-detection state after a predetermined erroneous detection time, which is shorter than the predetermined seating determination time, elapses after the detection sensor is brought into the detection state.

5. The toilet seat device according to claim 2,
wherein the controller controls the opening/closing device such that the opening/closing device opens the toilet seat based on determination that the detection sensor is brought into the non-detection state after a predetermined erroneous detection time, which is shorter than the predetermined seating determination time, elapses after the detection sensor is brought into the detection state.

6. The toilet seat device according to claim 2,
wherein the detection sensor is configured to switch on/off of a mechanical contact thereof when a pressing force in a gravity direction is applied to the toilet seat, and
the controller controls the opening/closing device such that the opening/closing device opens the toilet seat based on determination that the detection sensor is brought into the non-detection state after a predetermined erroneous detection time, which is shorter than the predetermined seating determination time and within which there is a possibility of erroneous detection due to chattering of the mechanical contact of the detection sensor, elapses after the detection sensor is brought into the detection state.

7. The toilet seat device according to claim 1,
wherein the detection sensor is configured to switch on/off of a mechanical contact thereof when a pressing force in a gravity direction is applied to the toilet seat.

8. The toilet seat device according to claim 7,
wherein the controller controls the opening/closing device such that the opening/closing device opens the toilet seat based on determination that the detection sensor is brought into the non-detection state after a predetermined erroneous detection time, which is shorter than the predetermined seating determination time, elapses after the detection sensor is brought into the detection state.

9. The toilet seat device according to claim 1,
wherein the controller controls the opening/closing device such that the opening/closing device opens the toilet seat based on determination that the detection sensor is brought into the non-detection state after a predetermined erroneous detection time, which is shorter than the predetermined seating determination time, elapses after the detection sensor is brought into the detection state.

10. The toilet seat device according to claim 1,
wherein the detection sensor is configured to switch on/off of a mechanical contact thereof when a pressing force in a gravity direction is applied to the toilet seat, and
the controller controls the opening/closing device such that the opening/closing device opens the toilet seat based on determination that the detection sensor is brought into the non-detection state after a predetermined erroneous detection time, which is shorter than the predetermined seating determination time and within which there is a possibility of erroneous detection due to chattering of the mechanical contact of the detection sensor, elapses after the detection sensor is brought into the detection state.

* * * * *